US005949379A

United States Patent [19]

Yang

[11] Patent Number: 5,949,379

[45] Date of Patent: Sep. 7, 1999

[54] MICROWAVE ANTENNA DEVICE ON PCMCIA NETWORK CARDS FOR NOTEBOOK COMPUTERS

[75] Inventor: Jui-Lin Yang, Tao-Yuan Hsien, Taiwan

[73] Assignee: Alpha Telecom Inc., Hsin Chu, Taiwan

[21] Appl. No.: 09/006,036

[22] Filed: Jan. 12, 1998

[51] Int. Cl.[6] ..... H01Q 1/24

[52] U.S. Cl. ..... 343/702; 343/757; 343/872

[58] Field of Search ..... 343/700 MS, 702, 343/906, 872, 873, 757, 882

[56] References Cited

U.S. PATENT DOCUMENTS

| | | | |
|---|---|---|---|
| 5,644,320 | 7/1997 | Rossi | 343/702 |
| 5,646,635 | 7/1997 | Cockson et al. | 343/702 |
| 5,657,028 | 8/1997 | Sanad | 343/700 MS |
| 5,821,903 | 10/1998 | Williams | 343/702 |
| 5,828,346 | 10/1998 | Park | 343/702 |

*Primary Examiner*—Hoanganh Le
*Assistant Examiner*—Tan Ho
*Attorney, Agent, or Firm*—Rosenberg, Klein & Bilker

[57] ABSTRACT

A microwave antenna device on PCMCIA network cards for notebook computers includes; extended base, which is connected to input port of PCMCIA network card, has pivot acceptor symmetrically located on the outer side of extended base, T-shaped pivot which is capable of 180-degree rotation about the vertical axis, is then supported by pivot acceptor. Tunnel is inside pivot and extended base, in which HF (high frequency) transmitting wire from input port passes through up to the top of pivot. Plate which is capable of 90-degree rotation in both clockwise and counter-clockwise direction is hooked up on pivot. Plate which is capable of 90-degree rotation in both clockwise and counter-clockwise direction is hooked up on pivot. Plate or bar microwave antenna is capped on pivot and connected through HF transmitting wire. In accordance with the above description, plate microwave antenna has the advantage of foldable for transportation easy to setup, receiving angle optimisable and preventing from breaking design.

2 Claims, 7 Drawing Sheets

MICROWAVE ANTENNA DEVICE ON PCMCIA NETWORK CARDS FOR NOTEBOOK COMPUTERS

FIELD OF THE INVENTION

This is invention relates to microwave antenna devices on PCMCIA network cards for notebook computers, and more specifically to an improved invention with advantages of foldable, space-saving, easy to setup, and angle-adjustable design.

BACKGROUND OF THE INVENTION

Due to their easy carrying nature, notebook computers have become an important tool for businessmen. A PCMCIA (personal computer memory card international association) network card is normally adopted as an interconnection between notebook computers and the networks. In the previous design of PCMCIA network cards, a cable is needed from the input port of the PCMCIA card and the local computer when needs to acquire information or receive e-mails through the network. However, if there are no computers available for linkage, the notebook computers are then restricted from accessing the network. This is inconvenient in practical use.

Hence, PCMCIA network cards with a microwave antenna have been developed in which a microwave antenna is either welded on screwed on the PCMCIA network cards. While the microwave antenna on presently available PCMCIA network cards is located on the side of the network computer in an upright, it is easy suffer from being bended or broken by careless users when typing on the keyboard.

FIG. 1 is an illustration of a microwave antenna on a PCMCIA network card for notebook computers according to the prior art. Mounting base (12) is extended from input port (11) of PCMCIA network card (1). Microwave antenna (2) is either directly welded on mounting base (12) or fastened with screw assembly (13). Insertion of network card (1) with microwave antenna (2) into slot (31) is needed whenever on needs access to the network. Network card (1) can be linked to any computers located in the receiving range of microwave antenna (2). A drawback is that while microwave antenna (2) on PCMCIA network card (1) is located on the side of the notebook computer in an upright position, microwave antenna (2) is easy to suffer from being bended or broken by careless users when typing on the keyboard. Furthermore, the permanently welded antenna which forms a right angle with the PCMCIA network card makes both transportation and storage difficult. Although, the screwed antenna can be dissembled from the PCMCIA network card. The loosely connection between the screwed antenna and the PCMCIA network card deteriorates the receiving ability.

Furthermore, the permanently welded antenna which forms a right angle with the PCMCIA network card makes both transportation and storage difficult. Although the screwed antenna can be dissembled from the PCMCIA network card, the loosely connection between the screwed antenna and the PCMCIA network card deteriorates the receiving ability. Not to mention that the separable antenna can be always missing and the redundancy while assembling.

Accordingly, a need exist for a microwave antenna device having a user-friendly nature.

SUMMARY OF THE INVENTION

In accordance with the present invention disadvantage and problems associated with the microwave antenna device on a PCMCIA network card for notebook computers have been substantially reduced or eliminated.

In accordance with one embodiment of the present invention, a microwave antenna device on a PCMCIA network card for notebook computers has the advantage of foldable, space-saving, and easy to use design.

In accordance with one embodiment of the present invention, a microwave antenna device on a PCMCIA network card for notebook computers can be prevented from breaking when hit accidentally during operation.

In accordance with another embodiment of the present invention, a microwave antenna device on a PCMCIA network card for notebook computers can be adjusted to the optimum angle for better receiving.

DETAILED DESCRIPTION OF THE INVENTION

Figure 1:
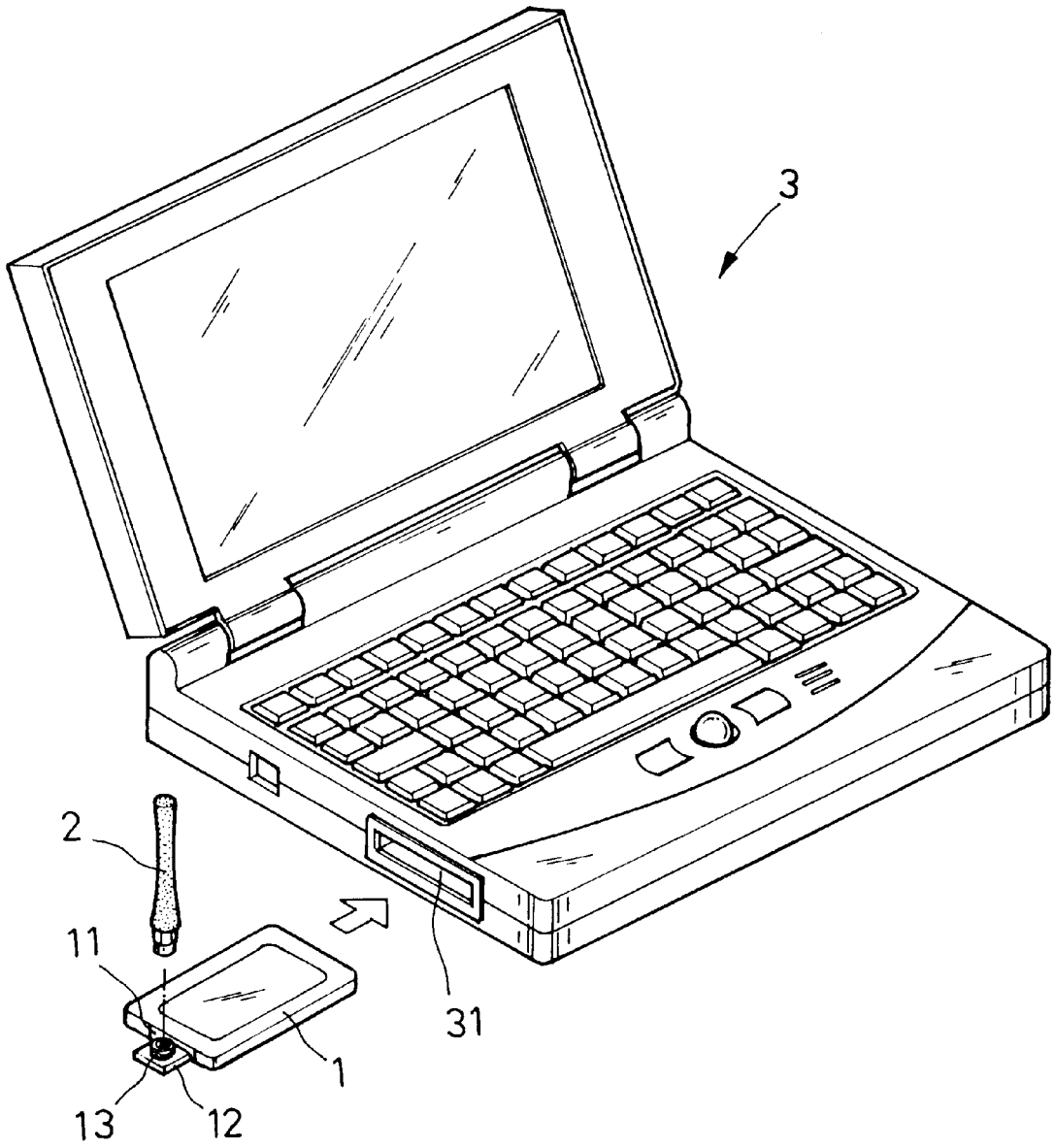
PRIOR ART FIG. 1
FIG. 1 is an illustration of a microwave antenna on a PCMCIA network card for notebook computers according to the prior art.
Figure 2:
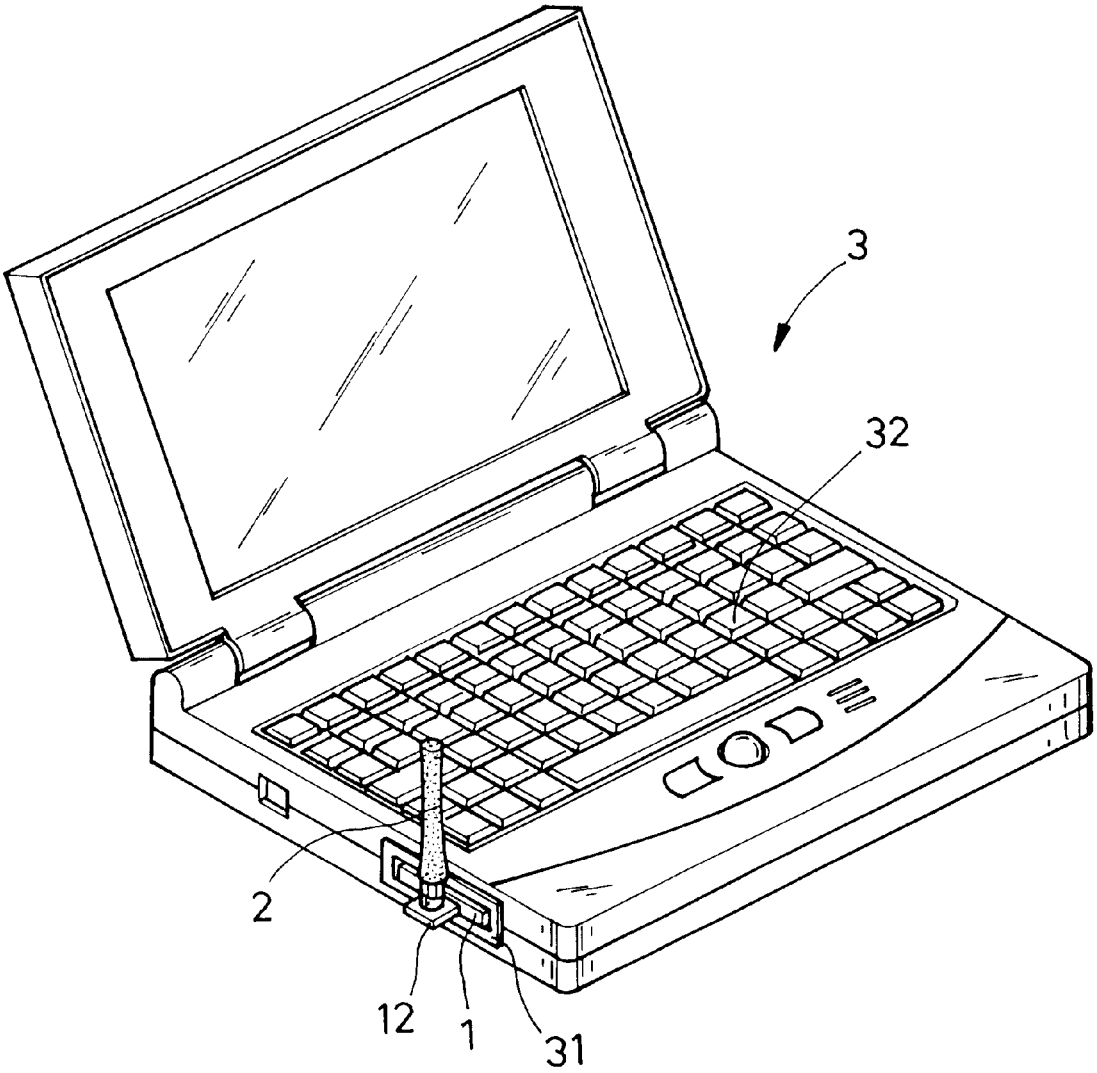
PRIOR ART FIG. 2
FIG. 2 is a demonstration of a microwave antenna on a PCMCIA network card for notebook computers according to the prior art.
Figure 3:
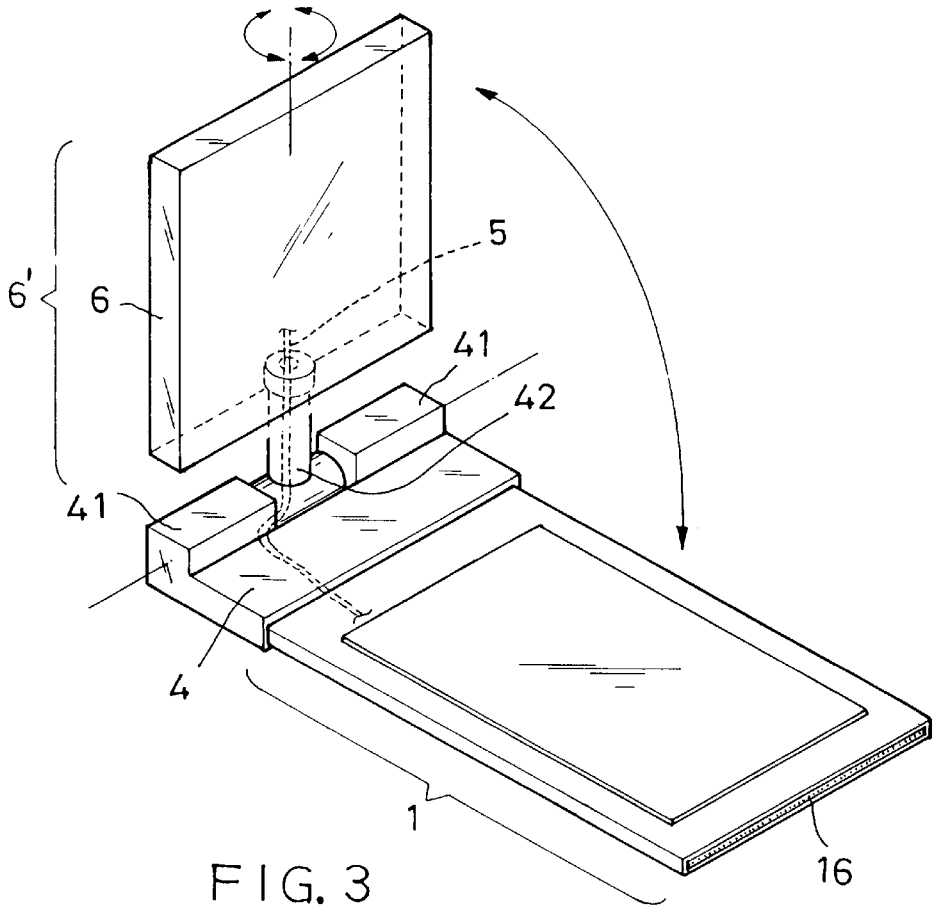
FIG. 3 illustrates one embodiment of the present embodiment of the present invention in unfolded conditions.
Figure 4:
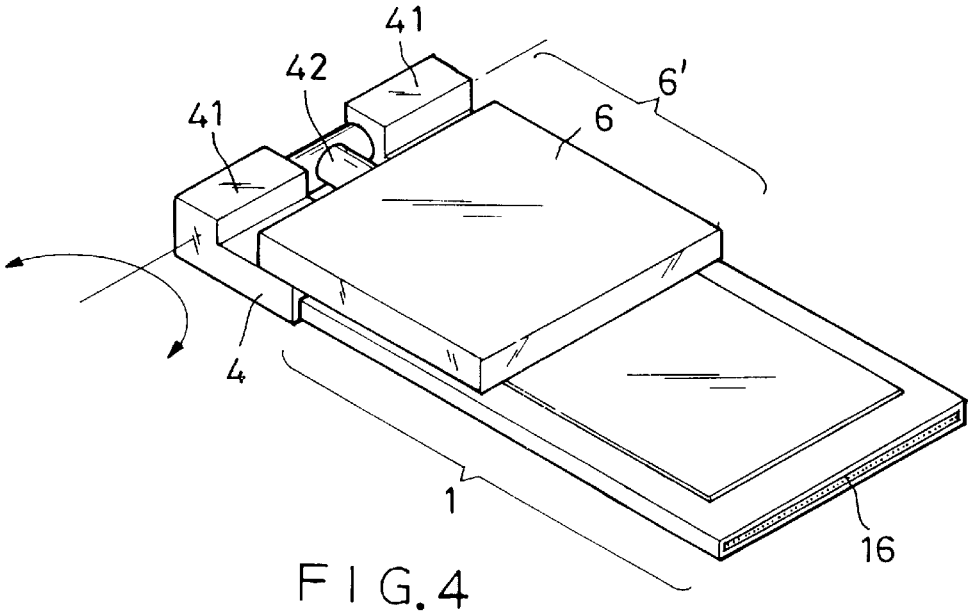
FIG. 4 illustrates one embodiment of the present invention in folded conditions.
Figure 5:
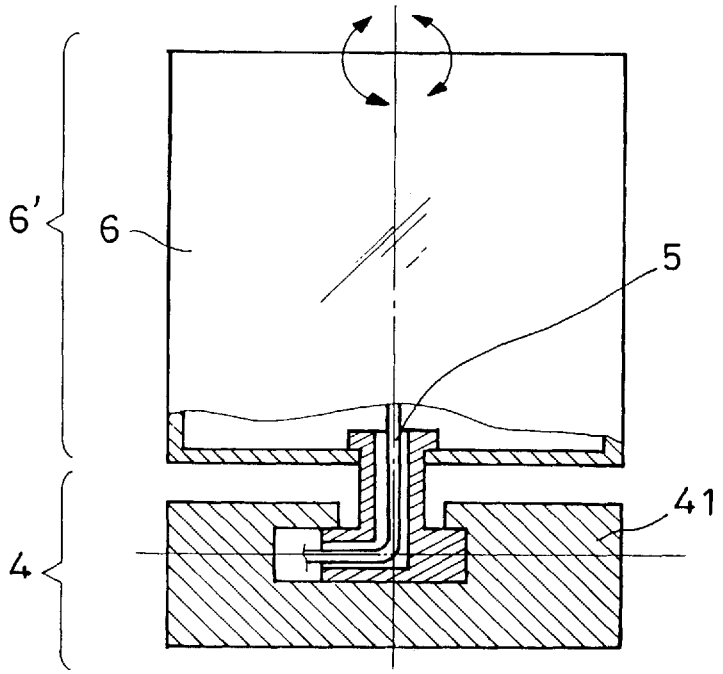
FIG. 5 is a cross-sectional elevation view of the shaped pivot according to the present invention.
Figure 6:
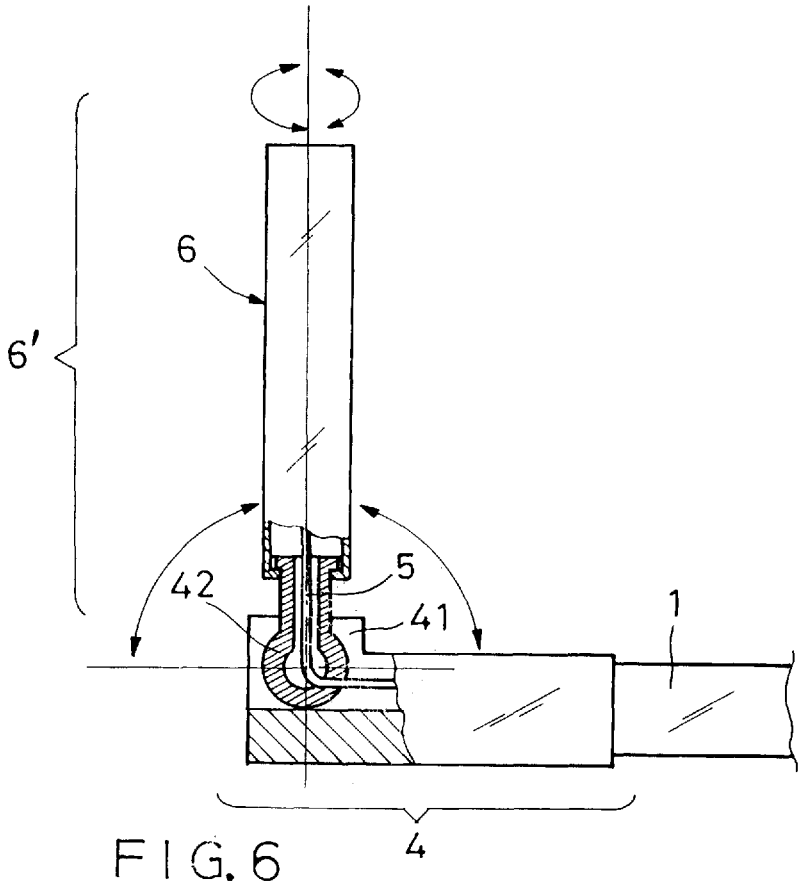
FIG. 6 is the rotation schematics of the plate microwave antenna according to the present invention.

FIGS. 3~6 illustrate the microwave antenna devices on PCMCIA network cards for notebook computers in the present invention. Extended base (4), which is connected to input port (11) of PCMCIA network card (1), has pivot acceptor (41) symmetrically located on the outer side of extended base (4).

T-shaped pivot (42) which is capable of 180-degree rotation about the vertical axis, is then supported by pivot acceptor (41). Tunnel is inside pivot (42) and extended base (4), in which HF (high frequency) transmitting wire (5) from input port (11) passes through up to the top of pivot (42). Plate (6) which is capable of 90-degree rotation in both clockwise and counter-clockwise direction is hooked up on pivot (42).

Plate (6) which is capable of 90-degree rotation in both clockwise and counter-clockwise direction is hooked up on pivot (42). Plate microwave antenna (6') is formed with the essentials of a microwave antenna embedded in plate (6) and connected through HF transmitting wire (5). In accordance with the above description, plate microwave antenna (6') has the advantage of foldable for transportation easy to setup, receiving angle optimizable and preventing from breaking design.

Figure 7:
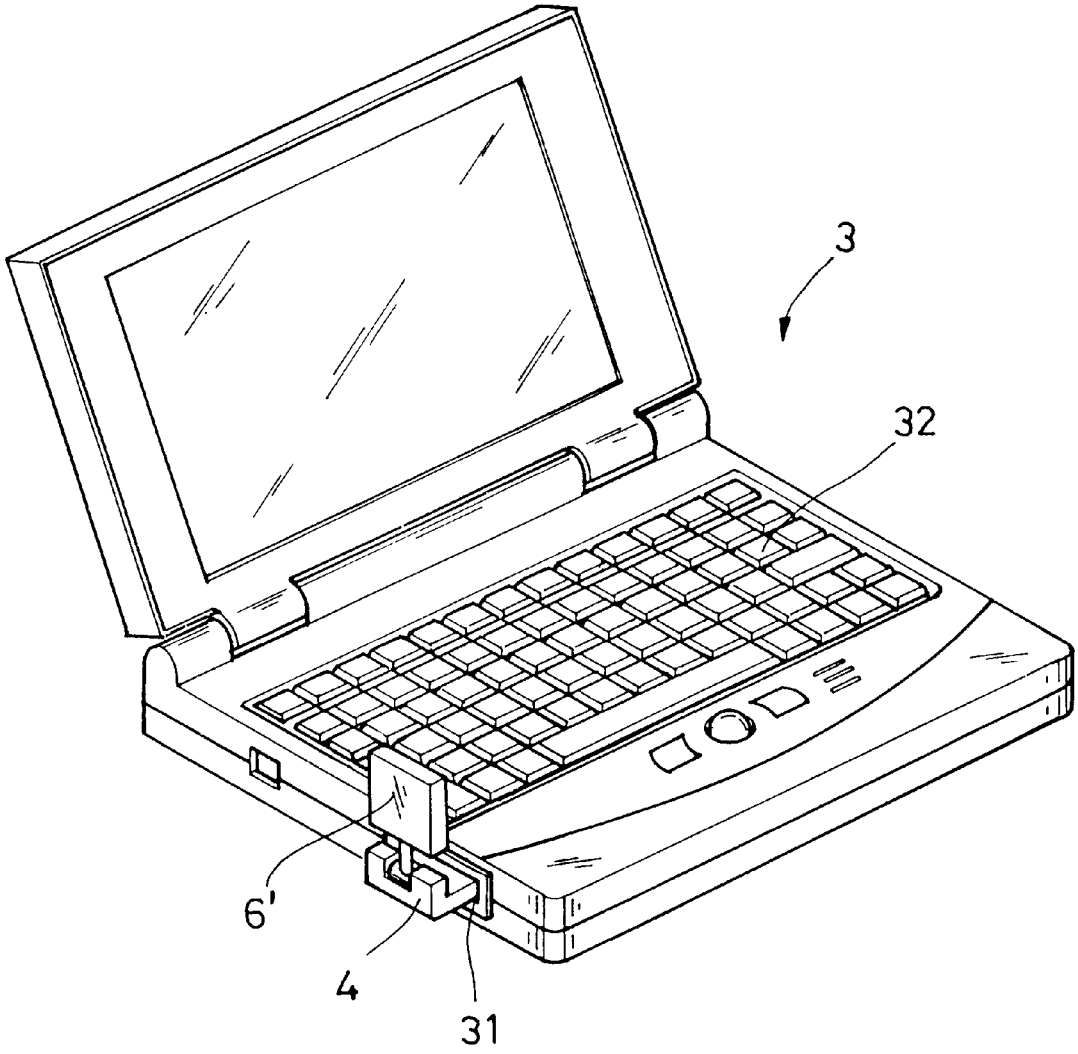
FIG. 7 is a demonstration in one embodiment of the present invention.

FIG. 7 is a demonstration in one embodiment of the present invention. According to the present invention, one needs only to unfold plate microwave antenna (6') shown in FIG. 4 and adjust to a position perpendicular to network card (1). Insertion of network card (1) with output port facing slot (31) is needed for wireless receiving. With the technique. Described above, the improvements of the present invention over the prior art are as followed:

1. Plate microwave antenna (6') is formed with the essentials of a microwave antenna embedded in plate (6) and connected through HF transmitting wire (5). One needs only to unfold plate (6) for instant connection instead of the redundancy when assembling the screwed microwave antenna. The carrying and easy to use, is therefore improved.

2. Another difference between the present invention and the prior art lies in that plate microwave antenna (6') in the present invention is not only foldable but capable of receiving angle optimizing while the prior art not.

3. Another advantage of the present invention is that proper distance (D) is kept, in the merit of extended base (4), between notebook computer (3) and unfolded plate microwave antenna (6'). So users won't hit the antenna by accident when typing on the keyboard. Even when plate microwave antenna (6') is hit accidentally, the rotation mechanism can prevent if from breaking and hence prolong the life time.

Figure 8:
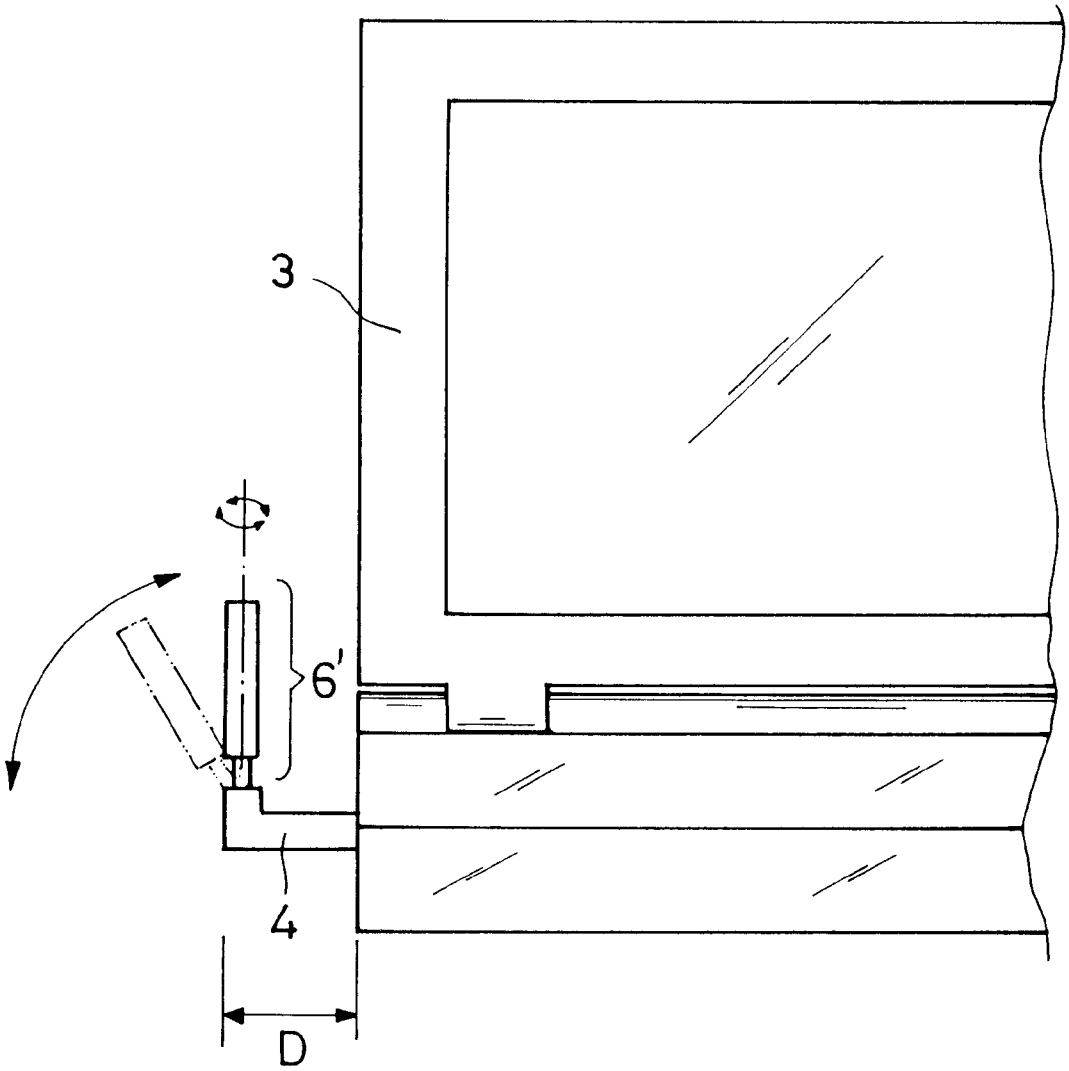
FIG. 8 is the angle-adjusting Schematics in one embodiment of the present invention.
Figure 9:
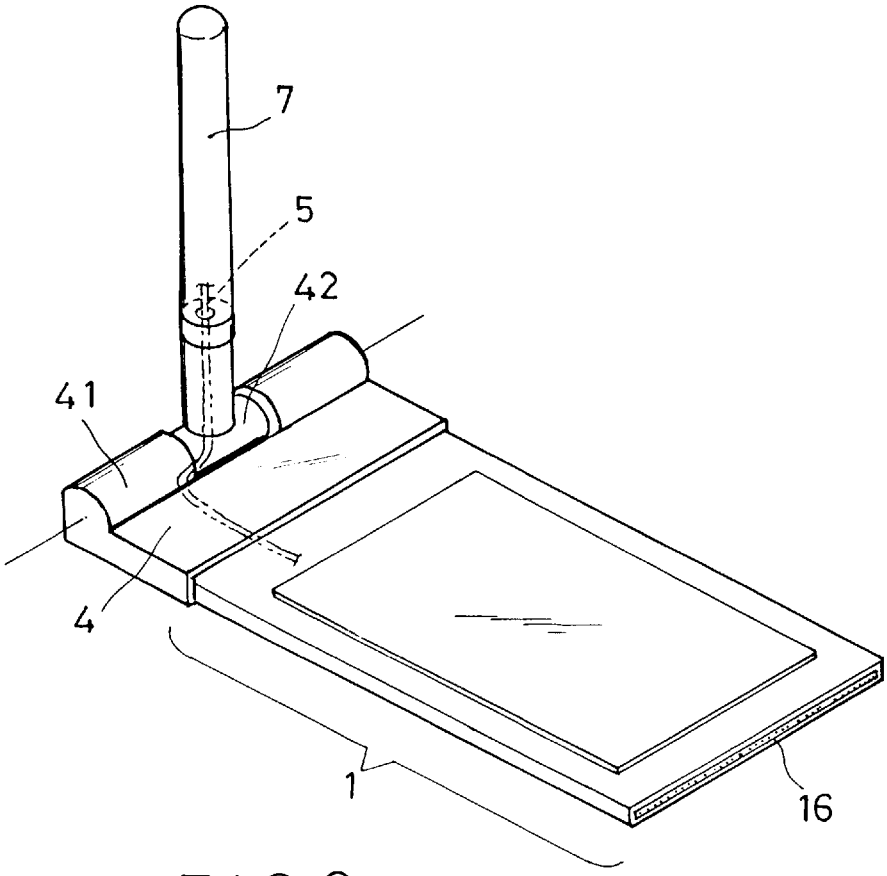
FIG. 9 illustrates another embodiment of the present invention in unfolded conditions.
Figure 10:
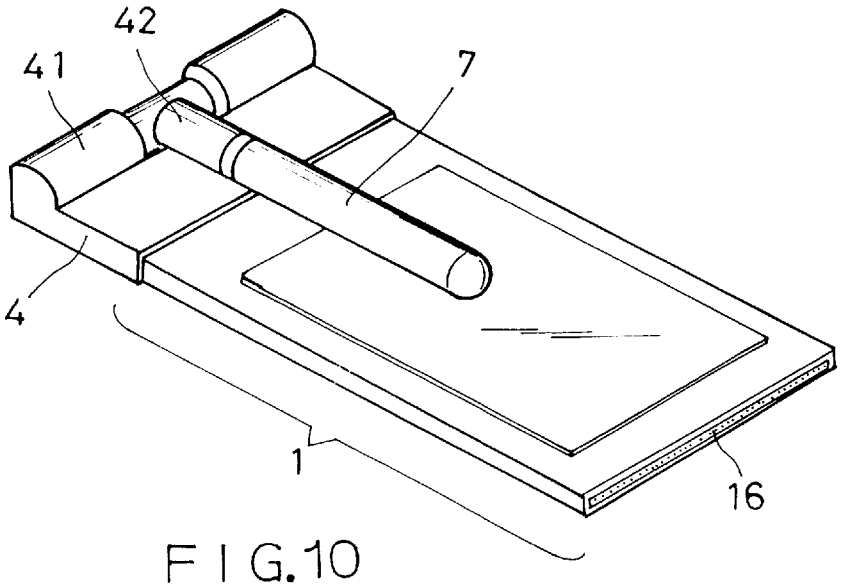
FIG. 10 illustrates another embodiment of the present invention in folded conditions.

Another embodiment of the present invention is shown in FIGS. 9 and 10. Bar microwave antenna (7), which is capped on pivot (42) and connected through HF transmitting wire (5) form network card (1), has the advantage of foldable, easy transportation, easy to setup, and preventing from breaking design. Meanwhile, bar microwave antenna (7) can receive signal from any direction. There is no need to search for optimum receiving angle. Bar microwave antenna (7) can be formed together with the shaped pivot during manufacture or can be capped on later with the pivot and the antenna made separately. Similar to the schematics in FIG. 8, proper distance (D) is kept between notebook computer (3) and bar microwave antenna (7). Users won't hit the antenna by accident when typing on the keyboard. Even when bar microwave antenna (7) is hit accidentally, the rotating mechanism can prevent it from breaking and hence prolong the life time.

Although the present invention has been described with several embodiments, a myriad off changes, variations, alterations, transformations, and modifications may be suggested to one skilled in the art, and it is intended that the present invention encompass such changes, variations, alterations, transformations, and modifications as fall within the spirit and scope of the appended claim.

What is claimed is:

1. A microwave antenna device on PCMCIA network cards for note book computers, comprising:

an extended base connected to the input port of the PCMCIA network card having a pivot acceptor symmetrically located on the outer side of the extended base;

a T-shaped pivot capable of 180-degree rotation about a vertical axis supported by the pivot acceptor;

a HF transmitting wire coupled to the input port and passing through the top of the pivot; and a plate coupled to the pivot, the plate being capable of 90-degree rotation in both clockwise and counter-clockwise directions, the plate housing a microwave antenna connected to the HF transmitting wire.

2. A microwave antenna device on PCMCIA network cards for note book computers, comprising:

an extended base connected to the input port of the PCMCIA network card having a pivot acceptor symmetrically located on the outer side of the extended base;

a T-shaped pivot capable of 180-degree rotation about a vertical axis supported by the pivot acceptor;

a HF transmitting wire coupled to the input port and passing through the top of the pivot; and a bar microwave antenna capable of 90-degree rotation in both clockwise and counter-clockwise directions coupled to the T-shaped pivot and connected to the HF transmitting wire.

* * * * *